US005810656A

United States Patent [19]

Dowdell et al.

[11] Patent Number: 5,810,656

[45] Date of Patent: Sep. 22, 1998

[54] TOXIC WORK ENCLOSURE

[75] Inventors: Geoffrey Keith Dowdell; James Judge, both of Salisbury; Brian James Stokes, Amesbury, all of Great Britain

[73] Assignee: The Secretary of State for defence in Her Britannic Majesty's Government of the United Kingdom of Great Britain and Northern Ireland, Farnborough, United Kingdom

[21] Appl. No.: 637,795

[22] PCT Filed: Nov. 4, 1994

[86] PCT No.: PCT/GB94/02431

§ 371 Date: May 21, 1996

§ 102(e) Date: May 21, 1996

[87] PCT Pub. No.: WO95/12465

PCT Pub. Date: May 11, 1995

[30] Foreign Application Priority Data

Nov. 5, 1993 [GB] United Kingdom ..... 9322983

[51] Int. Cl.[6] ..... B08B 15/02

[52] U.S. Cl. ..... 454/56; 454/187

[58] Field of Search ..... 454/56, 187

[56] References Cited

U.S. PATENT DOCUMENTS 3,874,754 4/1975 Saunders et al. .
3,895,570 7/1975 Eagleson .
4,215,627 8/1980 Garris .
5,257,957 11/1993 Diccianni et al. .

FOREIGN PATENT DOCUMENTS 55-18134 5/1980 Japan ..... 454/60
2 115 718 9/1983 United Kingdom .

OTHER PUBLICATIONS

Patent Abstracts of Japan, Pat. 59120086, vol. 8, No. 236, 30 Oct. 1984.

Patent Abstracts of Japan Pat. 2144157, vol. 14, No. 386, 21 Aug. 1990.

Patent Abstracts of Japan, Pat. 3038257, vol. 15, No. 167, 26 Apr. 1991.

*Primary Examiner*—Harold Joyce
*Attorney, Agent, or Firm*—Nixon & Vanderhye

[57] ABSTRACT

A toxic work enclosure (1) with a port (14) and a vent (18) that when installed within a fume cupboard (64) with both the port (14) and the vent (18) open, provides safe access to toxic materials, if present, in the toxic work enclosure (1); but with both the port (14) and the vent (18) closed, closed position isolates the toxic work enclosure (1) allowing environmental control of the air (104) within the toxic work enclosure (1), or safe removal of the toxic work enclosure (1) from the fume cupboard (64) by containment of toxic materials, if present, in the toxic work enclosure (1).

13 Claims, 2 Drawing Sheets

Figure 3:
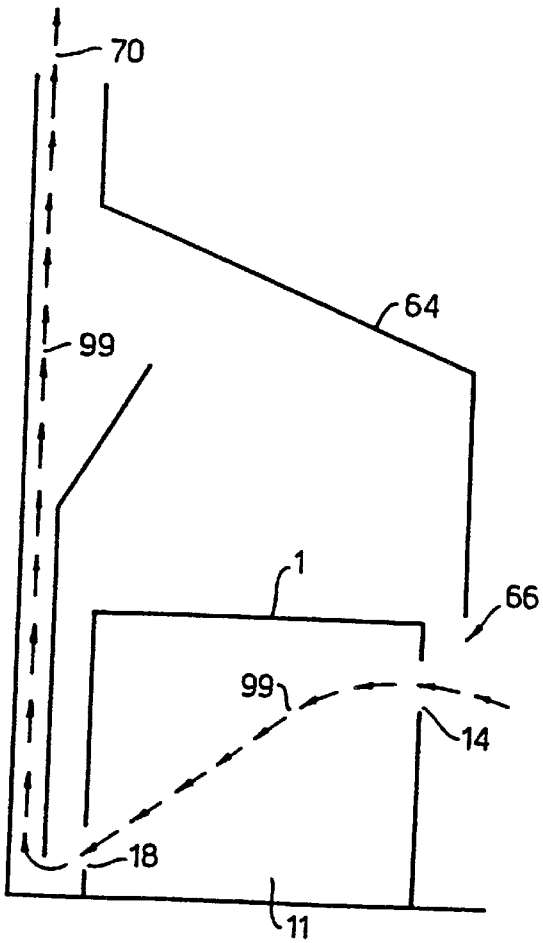

FIG. 1
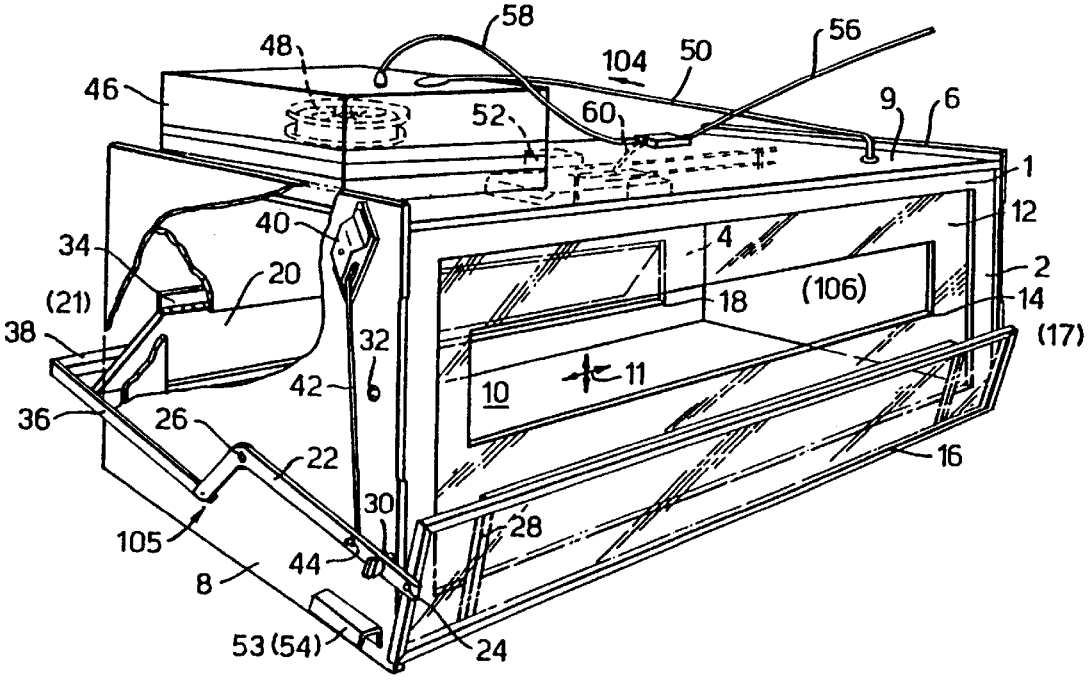
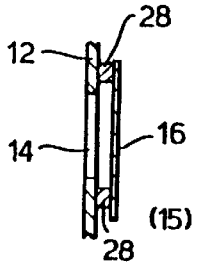
FIG. 1A
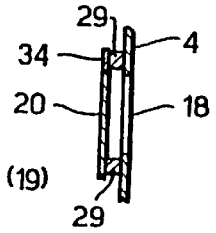
FIG. 1B

TOXIC WORK ENCLOSURE

Toxic work enclosures provide a safe working environment for a technician engaged in using various toxic or extremely hazardous materials, including chemical and biological agents, by isolating the hazardous materials from the technician, whilst permitting safe access to the materials.

Laboratories are often equipped with fume cupboards to prevent direct exposure to the potentially hazardous materials normally found in, for example, a chemical laboratory. Fume cupboards consist of an internal working space with an aperture closeable with a usually transparent door, the internal working space being provided with a usually forced draught which induces an airflow from the laboratory into the aperture, which is not air-tight even when closed, through the internal working space and out of an exhaust leading from the internal working space usually into the atmosphere. However, fume cupboards do not allow economical and effective control of environmental conditions such as temperature, and humidity.

Known toxic work enclosures, such as the work stations described in U.S. Pat. No. 4,637,301, and the safety cabinets described in Canadian Patent 1 126 566 create an airflow through an internal working space away from the technician. They include a vertical air barrier or curtain passing downwards across the aperture giving access to the internal working space, preventing release of toxic substances into the laboratory.

A disadvantage of the toxic work enclosures described in the above mentioned prior art documents is that the internal working space cannot be sealed to permit control of the environmental conditions within the internal working space. For example the temperature or humidity cannot be controlled.

Another disadvantage is that should an unexpected event occur in the internal working space during an experiment the working space, or apparatus containing the working space cannot be removed expeditiously from the laboratory for disposal.

According to the present invention an enclosure is provided including a work compartment; an air intake means, connecting to the work compartment, closeable by a first closure means moveable between a closed and an open position; an air discharge means, connecting to the work compartment, closeable by a second closure means moveable between a closed and an open position; and a connecting means operatively relating the movement of the first closure means between a closed and an open position, to the movement of the second closure means between a closed and an open position; characterised in that the enclosure is arranged to be positioned in a fume cupboard having an internal space connecting to an access aperture and to an exhaust means capable of moving air into the access aperture, through the internal space and out of the exhaust means, the air intake means facing the access aperture, the air discharge means facing the exhaust means; moving the first closure means to the open position and moving the second closure means to the open position defines an air pathway leading from the access aperture into the intake means, through the work compartment, out of the air discharge means and to the exhaust means; in use the exhaust means moves a second airstream, a portion of the air entering the access aperture, along the air pathway, enabling safe access to toxic materials, if present, in the work compartment; moving the first closure means to the closed position and moving the second closure means to the closed position isolates the work compartment enabling environmental control of the air within the work compartment, or safe removal of the enclosure from the fume cupboard by containment of toxic materials, if present, in the work compartment.

U.S. Pat. No. 4,637,301 describes a work station for use with hazardous or toxic substances in which a removable insert work compartment may be easily removed from the work station housing for cleaning or replacement in the event that the work enclosure becomes contaminated. Also described in U.S. Pat. No. 4,637,301 is a chute connecting the work station with an awaiting container that can be used to dispose of contaminated materials, so that no contaminants are exposed to the ambient environment. U.S. Pat. No. 4,637,301 has the following disadvantages: the removable insert work compartment cannot be closed prior to removal from the work station, and the work station is unsuitable for use with toxic gases or vapours.

By contrast with U.S. Pat. No. 4,637,301 it is an objective of the current invention to provide a portable enclosure for installation within a fume cupboard and that with both the air intake means and the discharge means open, the working conditions are similar to those in a fume cupboard without the portable enclosure; but with both the air intake means and the air discharge means closed allows temperature, or other environmental control of the atmosphere within the work compartment during an experiment.

Also contrary to the teaching of U.S. Pat. No. 4,637,301 it is a further objective of the current invention to provide a portable enclosure that may be closed prior to safe removal from the fume cupboard preventing toxic material, whether in the form of solids liquids or gases, which may be present within the work compartment dispersing into the ambient environment.

According to another aspect of the invention, the enclosure may include connecting means operatively relating the opening and closing of the first closure means to the opening and closing of the second closure means. The connecting means may be arranged so that the first closure means opens after the second closure means opens and the second closure means closes after the first closure means closes. Alternatively, the connecting means may be arranged so that the first closure means opens at substantially the same time as the second closure means opens, and the first closure means closes at substantially the same time as the second closure means closes.

According to yet another aspect of the invention, the connecting means may be an electromechanical, pneumatic, or a mechanical arrangement.

Alternatively, the opening and closing of the first closure means and the opening and closing of the second closure may be controlled manually.

According to yet another aspect of the invention, the enclosure may include a mechanism capable of locking the first closure means and the second closure means in the closed position. The enclosure may be provided with carrying handles so that with the first and second closure means locked in the closed position the enclosure may be safely removed from the fume cupboard.

Preferably, the air intake means is a port in the enclosure and the first closure means is a first plate overlapping the port and may engage a seal between the enclosure and the first plate. The advantage in having a plate to cover the air intake port is that a large inlet port can be used which permits relatively large items to be inserted into, or withdrawn from the work compartment, whilst the airflow is maintained in a safe direction.

Preferably, the air discharge means is a vent in the enclosure and the second closure means is a second plate overlapping the vent and may engage a seal between the enclosure and the second plate. The advantage in having a plate to cover the vent in the enclosure is that a large outlet vent can be used which gives minimal hindrance to the airflow when it open (that is uncovered), but when closed (that is covered) permits efficient control of the internal atmosphere.

According to yet another aspect of the invention the enclosure may be a rectangular box comprising a top panel, a bottom panel, a front panel, a rear panel and two side panels, the port being formed in the front panel of the box, and the vent being formed in the rear panel of the box, so that when the enclosure is in use in the fume cupboard the port faces towards the access aperture of the fume cupboard, and the vent faces towards the exhaust means of fume cupboard.

According to yet another aspect of the invention with the enclosure in the form of a rectangular box a mechanical arrangement may connect the first plate and the second plate, and may comprise a hinge that may connect the second plate to the enclosure and a lever that may rotate about a pivot that may be mounted on one side of the box, one end of lever may be rotatably connected to an edge of the first plate and the other end may terminate in a crank jointed to a rod connecting with the second plate whereby movement of the first plate from the closed to the open position may be mimicked by movement of the second plate from the closed to the open position, and movement of the first plate from the open to the closed position may be mimicked by movement of the second plate from the open to the closed position. In order that both ends of the first plate and both end of the second plate are mechanically supported the set comprising a lever, a rod, and a pivot may be duplicated so that one set may be mounted on one side of the box and the other set may be mounted on the opposite side of the box. In addition, a counterbalance may be provided so that the first plate or the second plate moves only when an opening or a closing load is applied to the first plate.

In another form of the invention the enclosure may be a rectangular box comprising a top panel, a bottom panel, a front panel, a rear panel and two side panels the port being formed in the front panel of the box, the vent being formed in the top panel of the box, so that when the enclosure is in use in the fume cupboard the port faces towards the access aperture of the fume cupboard, and the vent faces towards the exhaust means of the fume cupboard.

In yet another form of the invention the enclosure may be rectangular box comprising a top panel, a bottom panel, a front panel, a rear panel and two side panels the port being formed in the side panel of the box, the vent being formed in the rear panel of the box, so that when the enclosure is in use in the fume cupboard the port faces towards the access aperture of the fume cupboard, and the vent faces towards the exhaust means of the fume cupboard.

Advantageously the first plate and the front panel panel may be formed from transparent material.

In comparison with a glove box which could be used for similar experiments, the use of the enclosure gives better access to the experiment, since there is no need for a transfer port or air lock. Neither does the experimenter need to wear the rubber gloves that are an essential part of a glove box.

According to yet another aspect of the invention the port and the vent may be closed for the duration of an experiment, should an unexpected event occur in the enclosure during the experiment, the enclosure can be taken out of the fume cupboard for safe disposal.

According to yet another aspect of the invention the enclosure may include: an air-filter (which may include a bed of activated charcoal), and air circulation means arranged to pass a proportion of air from the work compartment through the filter and back to the work compartment; means to control the air temperature of the work compartment: and means to control the humidity of the air in the work compartment. An enclosure according to the invention without a charcoal filter, temperature, and humidity control, is safe for use with toxic materials. However, it is undesirable for a toxic vapour concentration to build up within the work compartment.

The build-up of toxic vapour concentrations can be prevented by circulation of a relatively small proportion of the air in the work compartment through an activated charcoal filter and returning it back to the work compartment as well as by controlling the temperature and humidity of the air in the work compartment.

Figure 2:
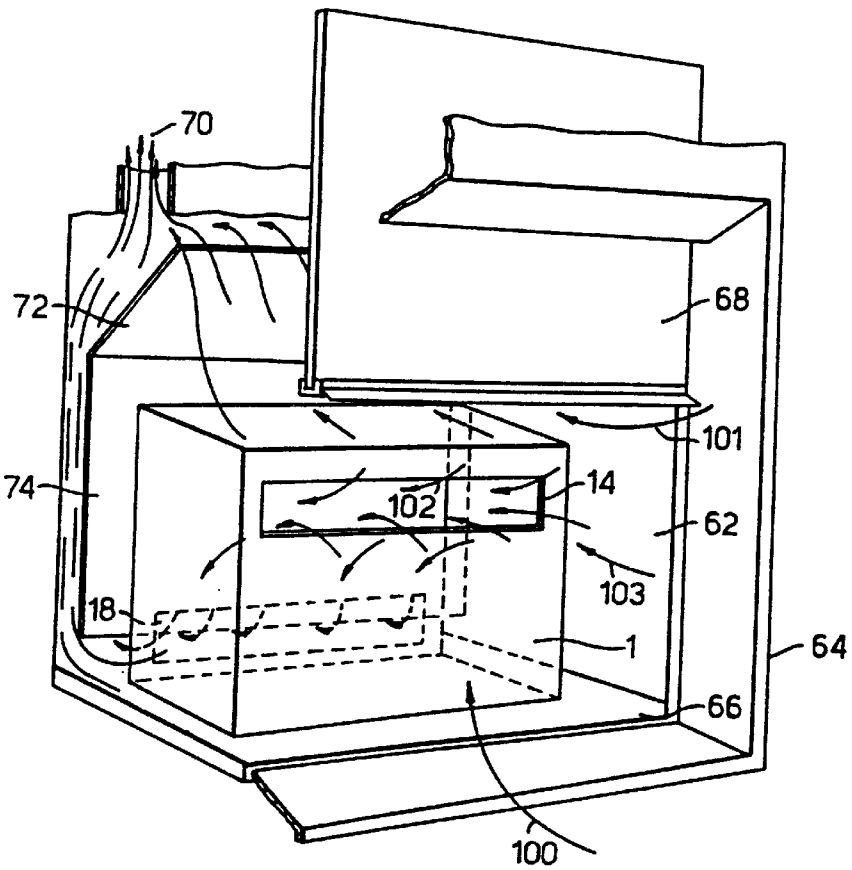

One embodiment of the invention will now be described, by way of example only, with reference to the accompanying drawings, of which:

FIG. 1 shows a perspective view of a toxic work enclosure according to the invention:

FIG. 1*a* shows a cross sectional view of the window of FIG. 1 which is closed by a first plate;

FIG. 1*b* shows a cross sectional view of the vent of FIG. 1 which is closed by a second plate;

FIG. 2 shows a typical air flow pattern induced in an around a toxic work enclosure according to the invention when placed within a fume cupboard. and FIG. 3 is a sectional side view of FIG. 2.

Referring first to FIG. 1, the toxic work enclosure comprises a rectangular box 1, with a front wall 2, a rear wall 4, a left hand side wall 6; a right hand side wall 8, top panel 9, and a bottom panel 10, enclosing a work compartment 11.

The front wall 2 has a viewing window 12, pierced by a port 14. The port can be closed by a first plate 16 which is also transparent as shown in FIG. 1*a*.

The rear wall 4, is pierced by a vent 18 that can closed by a second plate 20 as shown in FIG. 1*b*.

The linkage, toggle fastener, and counterbalance unit, items 22, 24, 26, 30, 32, 36, 40, 42, and 44, generally labeled 105, shown adjacent the left hand side wall 8 are duplicated to form a linkage, toggle fastener, and counterbalance unit, generally labelled 106, adjacent to the right hand side wall 6. In order to simplify the description only the items adjacent to left hand side wall 8 will be described.

The first plate 16 is attached at its left hand side to one end of a cranked lever 22 by a pin 24, and at its right hand side to the duplicate pin and lever (not drawn). The cranked lever 22, hinges about a pivot 26 mounted on the left hand side wall 8, so that the first plate 16 is allowed to move from an open to a closed position. In the closed position the first plate 16 traps a seal 28 (mounted on the inside of the front plate 16) between the first plate 16 and the viewing window 12.

The first plate 16, can be locked in the closed position 15 by a toggle fastener 30 that engages in a clip 32 mounted on the left hand side wall 8.

The second plate 20 is hinged along its top edge by the hinge 34, moving between a closed position 19, and an open position 21, and engages a seal 29 between the second plate 20 and the rear wall 4 in the closed position 19.

The first plate 16 and the second plate 20 are connected mechanically by a rod 36 that connects the cranked lever 22 to a bar 38 that is joined to the second plate 20 so that movement of the first plate 16 is mimicked by the second plate 20. The bar 38 connects at its other end to similar linkage 106, adjacent to the right hand side wall 6.

A counterbalance unit 40, mounted on the left hand side wall 8 anchors one end of a partially coiled spring 42, the other end of which is is anchored at point 44 on the cranked lever 22. The counter balance unit 40 counterbalances movement of the front cover 16 or the second plate 20 when an opening or a closing load is applied to the first plate 16. A similar counterbalance unit (not drawn) is mounted on the right hand side wall 6.

Mounted on the top panel 9 is a self contained charcoal filter unit 46, with a built in fan 48. A pipe 50, one end of which pierces the top panel 9, passes air 104, from the work compartment 11, to the inlet side of the charcoal filter unit 46. The fan 48, draws the air 104, through the charcoal filter unit and returns filtered air, to the work compartment 11 through an outlet duct (not drawn) that also pierces the top panel 9.

A convenient flow rate for the fan 48 has been found to be 32.6 $ls^{-1}$.

Mounted within the work compartment 11, on the under side of the top panel 9, is a self-contained temperature and humidity control system 52.

Cables 56, 58 and 60 connect the charcoal filter unit and the temperature and humidity control unit to a mains voltage electrical supply.

Carrying handles 53 and 54 are mounted on the side walls 8 and 6.

Referring to FIG. 2, which shows the toxic work enclosure 1, (with both the port 14 and the vent 18 open) placed within the internal space 62, of a fume cupboard 64. The fume cupboard has an access aperture 66 which can be closed by a sliding door 68, and an extraction system 70 that draws air 100, into the fume cupboard through the access aperture 66. The air 100, entering the fume cupboard 64, breaks in to three air streams 101, 102, and 103, as it passes through the fume cupboard 64.

The first air stream 101, passes over the toxic work enclosure 1, the baffle 72, and out through the extraction system 70.

The second air stream 102, passes through the air intake 14, through the work compartment 11, through the vent 18, under the false panel 74, and out through the extraction system 70.

The second air stream 102 follows an air pathway 99 shown as a sectional side view in FIG. 3.

The third air stream 103, passes around the enclosure 1, under the false panel 74, and out through the extraction system 70.

In order to improve the safety of the toxic work enclosure 1, it will also be readily understood by persons skilled in the art that the mechanical linkages, shown generally in FIG. 1 as items 105 and 106 operatively connecting the first plate 16 to the second plate 20 may be modified, so that the first plate 16 opens after the second plate 20 opens and the second plate 20 closes after the first plate 16 closes.

It will be understood by persons skilled in the art that the mechanical linkage, shown in FIG. 1 as items 22, 24, 26, 30, 32, 36, 38, 40, 42, and 44, operatively connecting the first plate 16 to the second plate 20 can be substituted by known electro-mechanical units, such as solenoid operated pistons controlling the opening and closing of the port 14 and the vent 16 electrically connected so that the movement of the first plate 16 is mimicked by movement of the second plate 20. In order to improve the safety of the toxic work enclosure, a timing device may be incorporated into the electrical circuit connecting the solenoid operated pistons so that the first plate 16 opens after the second plate 20 opens and the second plate 20 closes after the first plate 16 closes.

It will also be readily understood by persons skilled in the art that the solenoid operated pistons may be substituted by the pneumatically operated pistons connected by air-lines so that the movement of the first plate 16 is mimicked by by movement of the second plate 20. In order to improve the safety of the toxic work enclosure, a delay unit may be incorporated into the air lines connecting the pneumatically operated pistons so that the first plate 16 opens after the second plate 20 opens and the second plate 20 closes after the first plate 16 closes.

The toxic work enclosure 1 has achieved the following performance when used in an example of a fume cupboard 64 that draws the air 100 into the fume cupboard at a speed 1 $ms^{-1}$ when the access aperture 66 is set at 450 mm for an empty fume cupboard 64. When the access aperture 66 is set at 800 mm, that is almost fully open the the air 100 is drawn in at a speed 0.5 $ms^{-1}$. When the toxic work enclosure 1 is inserted into the example fume cupboard 64 with the air intake means and the air discharge means open the air 100 is drawn in at a speed of 0.5 $ms^{-1}$ with the access aperture set at 450 mm.

We claim:

1. An enclosure (1) including a work compartment (11); an air intake means (14), connecting to the work compartment (11), closeable by a first closure means (16) moveable between a closed (15) and an open (17) position; an air discharge means (18), connecting to the work compartment (11), closeable by a second closure means (20) moveable between a closed (19) and an open (21) position; and a connecting means (105, 106) operatively relating the movement of the first closure means (16) between a closed (15) and an open (17) position, to the movement of the second closure means (20) between a closed (19) and an open (21) position; characterised in that the enclosure (1) is arranged to be positioned in a fume cupboard (64) having an internal space (62) connecting to an access aperture (66) and to an exhaust means (70) capable of moving air (100) into the access aperture (66), through the internal space (62) and out of the exhaust means (70), the air intake means (14) facing the access aperture (66), the air discharge means (18) facing the exhaust means(70); moving the first closure means (16) to the open position (17) and moving the second closure means (20) to the open position (21) defines an air pathway (99) leading from the access aperture (66) into the intake means (14), through the work compartment (11), out of the air discharge means (18) and to the exhaust means (70); in use the exhaust means (70) moves a second airstream (102), a portion of the air (100) entering the access aperture (66), along the air pathway (99), enabling safe access to toxic materials, if present, in the work compartment (11); moving the first closure means (16) to the closed position (15) and moving the second closure means (20) to the closed position (19) isolates the work compartment (11) enabling environmental control of the air (104,105) within the work compartment (11), or safe removal of the enclosure (1) from the fume cupboard (64) by containment of toxic materials if present in the work compartment (11).

2. An enclosure (1) as claimed in claim 1 characterised in that the connecting means (105, 106) is arranged so that movement of the first closure means (16) from the closed (15) to the open (17) position occurs after movement of the second closure means (20) from the closed (19) to the open (21) position and movement of the second closure means (20) from the open (21) to the closed position (19) occurs after movement of the first closure means (16) from the open (17) to the closed (15) position.

3. An enclosure (1) as claimed in claim 1 characterised in that the connecting means (105, 106) is arranged so that movement the first closure means (16) from the closed (15) to the open position (17) occurs substantially at the same time as movement of the second closure means (20) from the closed (19) to the open position (21) and movement of the the second closure means (20) from the open (21) to the closed (19) position occurs substantially at the same time as movement of the first closure means (16) from the open (17) to the closed (15) position.

4. An enclosure (1) as claimed in claim 1 characterised in that the first closure means (16) is lockable in the closed position (15) and the second closure means (20) is lockable in the closed position (19) by a locking mechanism (30, 32).

5. An enclosure (1) as claimed in claim 1 characterised in that the connecting means (105, 106) is a mechanical arrangement (105, 106), an electromechanical arrangement, a pneumatic arrangement, or is capable of manual operation.

6. An enclosure (1) as claimed in claim 1 characterised in that the air intake means (14) is a port (14) in the enclosure (1) and the first closure means (16) is a first plate (16) capable of covering the port (14) and engaging a first seal (28) between the enclosure (1) and the first plate (16).

7. An enclosure (1) as claimed in claim 1 characterised in that the air discharge means (18) is a vent (18) in the enclosure (1) and the second closure means (20) is a second plate (20) capable of covering the vent (18) and engaging a second seal (29) between the enclosure (1) and the second plate (20).

8. An enclosure (1) as claimed in claim 1 characterised in that temperature control and humidity control means (52) are provided so that movement of the first plate (16) to the closed position (15) and movement of the second plate (20) to the closed position (19) permits environmental control of the air (104, 105) within the work compartment (11).

9. An enclosure (1) as claimed in claim 1 characterised in that the work compartment (11) connects to an air-filter (46), and air circulation means (48) arranged to pass a proportion of the air (104) from work compartment (11) through the air-filter (46) and to return filtered air (105) back to the work compartment (11); to prevent toxic vapour, if present within the work compartment (11), building up to an undesirable concentration.

10. A method for handling toxic materials using a fume cupboard (64) with an internal space (62) connecting to an access aperture (66) and to an exhaust means (70) capable of moving a first airstream (101) into the access aperture (66), through the internal space (62) and out of the exhaust means (70), characterised in that it includes the steps of:

placing in the internal space (62), an enclosure (1) having a work compartment (11); an air intake means (14), connecting with the work compartment (11) closeable by a first closure means (16) and moveable between a closed (15) and an open (17) position; an air discharge means (18), connecting with the work compartment (11) closeable by a second closure means (20) and moveable between a closed (19) and an open (21) position; the air intake means (14) facing towards the access aperture (66);

the air discharge means (18) facing towards the exhaust means (70);

starting the exhaust means (70);

moving the second closure means (20) to the open position (21);

moving the first closure means (16) to the open position (17); to induce a second airstream (102) to flow into the air intake means (14), through the work compartment (11), out of the air discharge means (18) and out of the exhaust means (70);

introducing toxic materials into the enclosure (1) through the air intake means (14); to enable handling of the toxic materials, if present, within the work compartment (11).

11. A method for isolating toxic materials using a fume cupboard (64) with an internal space (62) connecting to an access aperture (66) and to an exhaust means (70) capable of moving a first airstream (101) into the access aperture (66), through the internal space (62) and out of the exhaust means (70), characterised in that it includes the steps of:

placing in the internal space (62), an enclosure (1) having a work compartment (11); an air intake means (14), connecting with the work compartment (11) closeable by a first closure means (16) and moveable between a closed (15) and an open (17) position; an air discharge means (18), connecting with the work compartment (11) closeable by a second closure means (20) and moveable between a closed (19) and an open (21) position;

with the air intake means (14) facing towards the access aperture (66);

and with the air discharge means (18) facing towards the exhaust means (70);

starting the exhaust means (70);

moving the second closure means (20) to the open position (21);

moving the first closure means (16) to the open position (17); to induce a second airstream (102) to flow into the air intake means (14), through the work compartment (11), out of the air discharge means (18) and out of the exhaust means (70);

introducing toxic materials into the enclosure (1) through the air intake means (14);

moving the first closure means (16) to the closed position (15);

moving the second closure means (20) to the closed position (19) to isolate the toxic materials, if present, within the work compartment (11).

12. A method for disposal of toxic materials using a fume cupboard (64) with an internal space (62) connecting to an access aperture (66) and to an exhaust means (70) capable of moving a first airstream (101) into the access aperture (66), through the internal space (62) and out of the exhaust means (70), characterised in that it includes the steps of:

placing in the internal space (62), an enclosure (1) having a work compartment (11); an air intake means (14), connecting with the work compartment (11) closeable by a first closure means (16) and moveable between a closed (15) and an open (17) position; an air discharge means (18), connecting with the work compartment (11) closeable by a second closure means (20) and moveable between a closed (19) and an open (21) position;

with the air intake means (14) facing towards the access aperture (66); and with the air discharge means (18) facing towards the exhaust means (70); starting the exhaust means (70); moving the second closure means (20) to the open position (21);

moving the first closure means (16) to the open position (17); to induce a second airstream (102) to flow into the air intake means (14), through the work compartment (11), out of the air discharge means (18) and out of the exhaust means (70);

introducing toxic materials into the enclosure (1) through the air intake means (14);

moving the first closure means (16) to the closed position (15);

moving the second closure means (20) to the closed position (19);

locking the first closure means (16) in the closed position (15);

locking the second closure means (20) in the closed position (19);

removing the enclosure (1) and the toxic materials, if present, from the internal space (62) for disposal.

13. A method for prevention of a build-up of an undesirable toxic vapour concentration using a fume cupboard (64) with an internal space (62) connecting to an access aperture (66) and to an exhaust means (70) capable of moving a first airstream (101) into the access aperture (66), through the internal space (62) and out of the exhaust means (70), characterised in that it includes the steps of:

placing in the internal space (62), an enclosure (1) having a work compartment (11); an air intake means (14), connecting with the work compartment (11) closeable by a first closure means (16) and moveable between a closed (15) and an open (17) position; an air discharge means (18), connecting with the work compartment (11) closeable by a second closure means (20) and moveable between a closed (19) and an open (21) position;

with the air intake means (14) facing towards the access aperture (66); and with the air discharge means (18) facing towards the exhaust means (70);

starting the exhaust means (70);

moving the second closure means (20) to the open position (21);

moving the first closure means (16) to the open position (17); to induce a second airstream (102) to flow into the air intake means (14), through the work compartment (11), out of the air discharge means (18) and out of the exhaust means (70);

introducing toxic materials into the enclosure (1) through the air intake means (14); moving the first closure means (16) to the closed position (15); moving the second closure means (20) to the closed position (19); locking the first closure means (16) in the closed position (15); locking the second closure means (20) in the closed position (19);

controlling the temperature and humidity of air (104) in the work compartment (11) using a temperature and humidity control system (52).

using an air circulation means (48) to pass the air (104) from the work compartment (11) through an air filter (46) and to return filtered air (105) to the work compartment (11); to prevent toxic vapour, if present within the work compartment (11), building up to an undesirable concentration.

* * * * *